United States Patent [19]

van de Wiel

[11] Patent Number: 4,584,468

[45] Date of Patent: Apr. 22, 1986

[54] ELECTRON IMAGE TUBE HAVING A TRAPPING SPACE FOR LOOSE PARTICLES

[75] Inventor: Johannes N. van de Wiel, Eindhoven, Netherlands

[73] Assignee: U.S. Philips Corporation, New York, N.Y.

[21] Appl. No.: 633,373

[22] Filed: Jul. 23, 1984

[30] Foreign Application Priority Data

Jul. 22, 1983 [NL] Netherlands ..... 8302616

[51] Int. Cl.[4] ..... H01J 31/50

[52] U.S. Cl. ..... 250/213 VT; 313/477 R

[58] Field of Search ..... 250/213 VT, 213 R; 313/424, 525, 526, 527, 528, 529, 530, 477 R

[56] References Cited

U.S. PATENT DOCUMENTS 4,213,055 7/1980 Schrijvers et al. ..... 250/213 VT 4,298,821 11/1981 Hendry ..... 317/477 R

*Primary Examiner*—David C. Nelms

*Assistant Examiner*—James Gatto

*Attorney, Agent, or Firm*—Joseph P. Abate

[57] ABSTRACT

For trapping loose particles remaining in the envelope of an electron image tube after manufacture or subsequently formed therein, the envelope has a trapping space (49 or 50) which is readily accessible to the loose particles but wherefrom the loose particles can escape only with great difficulty, and which is such that particles trapped therein will not substantially adversely affect normal operation of the tube. The entrance of the trapping space suitably is a funnel-like slit (46 or 48) directed towards the interior of the trapping space (49 or 50). The trapping space (49, 50) is preferably in a region of the envelope free of strong fields which occur during normal operation of the tube.

7 Claims, 1 Drawing Figure

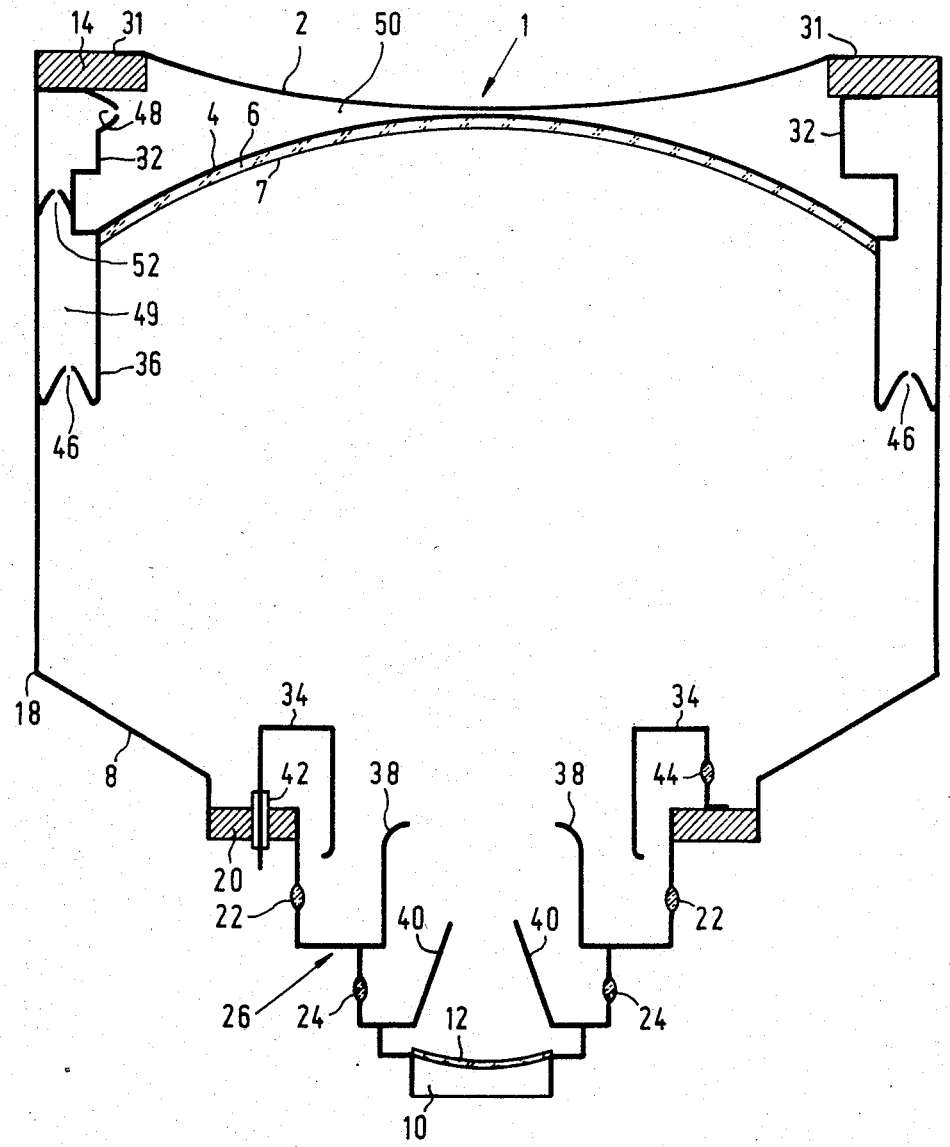
14
31
2
50
1
31
48
4
6
32
32
7
52
49
36
46
46
18
34
34
8
42
38
38
44
20
22
40
40
22
26
24
12
24
10

ELECTRON IMAGE TUBE HAVING A TRAPPING SPACE FOR LOOSE PARTICLES

BACKGROUND OF THE INVENTION

The invention relates to an electron image tube comprising an image-forming screen, an electron-optical imaging system, and a trapping space for loose particles in the tube which are accommodated in an envelope.

A tube of this kind is known in the form of an X-ray image intensifier tube from GB No. 776,351. In a tube described therein, an incident image-carrying X-ray beam is converted into an image-carrying beam of photoelectrons in an entrance screen which comprises a layer of X-ray luminescent material and a photocathode. The electron-optical system converts the beam of photoelectrons into a visible image in an exit screen of the tube which also comprises a layer of luminescent material. The trapping space for loose particles is constructed as a side portion of the tube. After assembly and sealing, loose particles which are liable to remain or be formed in such a tube can be trapped in such a space. Such loose particles may consist of, for example, metal, insulating material, phosphor material or external dust, and can exert a seriously disturbing effect during operation of the tube. The particles can, for example, cause undesirable electrical charging phenomena with field emission or even electrical breakdown. Moreover, when deposited on a sensitive side of an image screen, loose particles can also directly distrub an image to be formed. However, a trapping space which projects from the tube is not very convenient.

SUMMARY OF THE INVENTION

It is an object of the invention to alleviate these drawbacks; to this end, an electron image tube as set forth in the opening paragraph is characterized in that inside the tube, there is provided a trapping space for trapping loose particles present in the tube, said space comprising an easy entrance but a difficult exit for the particles.

After the finishing of the tube, the loose particles in a tube embodying the invention can be readily trapped in a trapping space, for example, by shaking or vibrating the tube in an adapted portion, by electrically charging the particles, or by applying magnetic fields, especially for ferromagnetic particles and so on. Due to the fact that the possibility of entry is relatively high, the particles can be trapped. Because the possibility of departure from the space is relatively low, the particles will tend to remain trapped therein. The particles in the trapping space cannot exert an adverse effect during normal operation of the tube. When the entrance of the trapping space is suitably constructed, it is virtually impossible for the particles to escape therefrom and the shape of the actual tube envelope need not be modified.

The trapping space in a preferred embodiment is closed by a slit which extends funnel-like towards the trapping space, and the entrance may comprise a cascade of trapping slits with a pronounced preferred direction of passage through the slits for the particles. For example, in an X-ray image intensifier tube, such a trapping space can be arranged so as to extend annularly to the entrance side of an entrance screen, or be enclosed by a bush having a uniform potential which is accommodated outside the image-forming space of the tube, for example, at a rear side of one of the electrodes of the electron-optical imaging system. A trapping space of this kind may also be provided with an opening which can be sealed from outside the tube, for example, by an adapted movement or an electrical or magnetical force and so on.

BRIEF DESCRIPTION OF THE DRAWING

Some preferred embodiments of the invention will be described in detail hereinafter with reference to the drawing which comprises a single FIGURE.

DESCRIPTION OF THE PREFERRED EMBODIMENTS

An X-ray image intensifier tube as shown in the drawing comprises an entrance side 1 with a vacuum-separating foil (entrance window) 2 and a screen-supporting foil 4 for an entrance luminescent screen 6. The luminescent screen 6 is composed, for example, as described in U.S. Pat. No. 3,825,763, the luminescent material being, for example, a layer of CsI. On the inner side of the luminescent layer 6, there is provided a photocathode 7, preferably, directly on the layer 6 but possibly with an intermediate separating layer. Besides the entrance window 2, the envelope of the tube furthermore comprises a jacket portion 8 and an exit window 10 which is in this case a fiber-optical window having a concave surface provided inner with an electron-sensitive luminescent screen 12. The envelope further comprises a first supporting ring 14 whereby the entrance foil 2 and the jacket portion 8 are interconnected. Behind a shoulder 18, the jacket portion 8 is connected to a second supporting ring 20. Between the supporting ring 20 and exit window 10, there is situated another jacket portion 26 which is insulated by insulating glass rings 22 and 24. The supporting rings 14 and 20 are made of, for example, stainless steel. The vacuum foil 2 is connected to the ring 14 by means of, for example, a welded joint 31 and consists of, for example, titanium foil having a thickness of from approximately 0.20 to 0.50 mm. The radius of curvature of the entrance foil 2 in an evacuated tube amounts to, for example, from 0.5 to 1.0 m in the present embodiment.

The screen-supporting foil 4 is suspended from the ring 14 via a supporting ring 32. An electrode 34, an electrode 38 and an electrode 40 of the electron-optical imaging system are also shown. A sleeve 36 which projects beyond the entrance screen is spaced from the jacket portion 8 and also forms part of the electron-optical system and customarily carries a potential which is equal to that of the photocathode.

By variation of the potential of, in particular, the electrode 38, a zoom effect can be realized, an entrance image of, in this case, from at the most approximately 35 cm to approximately 15 cm being displayed on the exit screen 12 in a focussed manner. The potential difference between the photocathode and the exit screen is always the same in operation and amounts to, for example, 35 kV. In a preferred embodiment, this zoom effect is realized so that three fixed preferred values can be selected, that is to say a potential for the cathode 38 of approximately 4 kV for a 35 cm entrance image, approximately 12 kV for a 25 cm entrance image, and approximately 35 kV for a 15 cm entrance image. Using an intermediate insulating bush 42 and a glass bead 44, the electrode 34 is connected to the supporting ring 20, so that the potential of this electrode can alos be adjusted to any desired value.

A trapping space 49 is formed by providing a funnel-like trapping slit 46 directed inwardly towards the space 49, for example, between the sleeve 36 and the wall 8. In other words, the sleeve 36 includes a funnel-shaped member which narrows to an opening 46; the funnel-shaped member narrows in a direction towards the trapping space 49. Alternatively, a trapping slit 48 can be provided in the supporting ring 32, directed inwardly towards the space 50 which will then act as a trapping space for loose particles. Once particles have entered this space or other similar spaces, it will be extremely difficult for these particles to escape from these spaces, while, on the other hand, the particles can be comparatively easily forced therein as indicated earlier. In order further to reduce the risk of escape of the trapped particles, a further slit 52 can be provided, for example, between the wall 8 and the sleeve 36 or the supporting ring 32, so that a cascade effect is obtained. Such a trapping slit may also be replaced by a slit with a movable valve which can be sealed and potentially reopened from the outside.

No high local electric fields occur in the spaces 49 and 50, because the potentials of the foil 2, the foil 4, the supporting ring 32 and the sleeve 36 do not differ substantially. Therefore, the particles will not exhibit disturbing electrical charging phenomena in these regions and they are so small that they will certainly not disturb the incident X-ray image. Instead of a trapping space being bounded by a component already present in the tube, a trapping space can alternatively be bounded by a box accommodated in any free room of the tube. Such a box may, for example, have an entrance formed by a readily accessible funnel-like trapping slit which is directed towards the interior of the box. An additional guarantee against the escape of loose particles from such a space can be obtained by providing at least a part of the inner wall thereof with, for example, a dust-capturing surface. However, this should be such as not to have an adverse effect on the atmosphere in the tube.

Even though the invention has been described mainly with reference to an X-ray image intensifier tube, it can be used for all kinds of electron image tubes in which loose particles are liable to exert a disturbing effect. Image-forming tubes always have room for a trapping space for loose particles.

What is claimed is:

1. An electron image tube, comprising:

an envelope including an entrance window, an exit window, and a jacket portion, the jacket portion being connected to the entrance window and the exit window;

an entrance luminescent screen accommodated within the envelope, the entrance luminescent screen being arranged adjacent to the entrance window;

an image-forming luminescent screen accommodated within the envelope, the image-forming luminescent screen being arranged adjacent to the exit window, and an electron-optical imaging system, accommodated within the envelope, for imaging electrons emerging from the entrance luminescent screen onto the image-forming luminescent screen, characterized in that the electron-optical imaging system includes a sleeve accommodated within the envelope, the sleeve being spaced from the jacket portion so that a trapping space is formed between the jacket portion and the sleeve, the sleeve including a funnel-shaped member which narrows to an opening, the funnel-shaped member narrowing in a direction towards the trapping space, so that loose particles within the tube can pass into the trapping space through the opening, the loose particles within the trapping space being trapped by the funnel-shaped member.

2. An electron image tube as claimed in claim 1, characterized in that a supporting ring and a support foil, for the entrance luminescent screen, are connected to the sleeve, the supporting ring being spaced from the jacket portion and including another funnel-shaped member which narrows to another opening, the another funnel-shaped member narrowing in a direction towards the another trapping space, the another trapping space being formed between the entrance window and the support foil for the entrance screen, so that loose particles within the trapping space can pass into the another trapping space through the another opening.

3. An electron image tube as claimed in claim 1, characterized in that the entrance window is a titanium metal foil.

4. An electron image tube as claimed in claim 3, characterized in that the titanium foil has a thickness of between approximately 0.20 and 0.50 millimeters.

5. An electron image tube as claimed in claim 4, characterized in that the titanium foil has a radius of curvature in a range between 0.5 meters and 1 meter.

6. An electron image tube as claimed in claim 1, characterized in that the trapping space is elongate in a direction generally parallel to the jacket portion.

7. An electron image tube as claimed in claim 1, characterized in that the trapping space is formed in the envelope in a region which is free from strong electric fields which occur during normal operation of the tube.

* * * * *